US005607359A

United States Patent [19]

Farmer, Sr.

[11] Patent Number: 5,607,359

[45] Date of Patent: Mar. 4, 1997

[54] USER PROPELLED MERRY-GO-ROUND

[76] Inventor: Charles E. Farmer, Sr., 1317 Jackson St., Owensboro, Ky. 42303

[21] Appl. No.: 595,650

[22] Filed: Feb. 2, 1996

[51] Int. Cl.[6] ..... A63G 1/12; A63G 1/22

[52] U.S. Cl. ..... 472/21; 472/22

[58] Field of Search ..... 472/14, 21, 22, 472/25, 26; 104/75; 482/57, 61

[56] References Cited

U.S. PATENT DOCUMENTS

| | | | |
|---|---|---|---|
| 3,203,695 | 8/1965 | Parker | 472/22 |
| 3,467,373 | 9/1969 | Justice | 472/22 |
| 5,246,400 | 9/1993 | Klucik | 472/21 |
| 5,263,902 | 11/1993 | Jones | 472/21 |

FOREIGN PATENT DOCUMENTS

| | | | |
|---|---|---|---|
| 716963 | 8/1965 | Canada | 472/14 |

*Primary Examiner*—Kien T. Nguyen

[57] ABSTRACT

A user propelled merry-go-round including a base with a post centrally coupled to a top surface thereof and extending upwards therefrom. Also included is a support pivotally coupled to the post. The support has a plurality of support members extending radially from the post. A plurality of wheel forks are each coupled to an associated support member and extended vertically downward therefrom with an axially aligned bore formed therein. A plurality of bicycle frames are each coupled to an associated support member with a seat situated thereon. Wheels with associated sprockets are each axially coupled to one of the forks via the bore thereof. A plurality of pedal units are axially coupled to an associated bicycle frame whereby the sprocket of the pedal unit and the sprocket of the wheel reside in a similar plane with a chain operatively coupled therebetween for allowing a user to precess about the post upon the rotation of the pedal unit.

7 Claims, 5 Drawing Sheets

USER PROPELLED MERRY-GO-ROUND

BACKGROUND OF THE INVENTION

1. Field of the Invention

The present invention relates to a user propelled merry-go-round and more particularly pertains to affording rotation of a merry-go-round using a bicycle-style method of propulsion.

2. Description of the Prior Art

The use of merry-go-rounds is known in the prior art. More specifically, merry-go-rounds heretofore devised and utilized for the purpose of providing entertainment are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,642,275 to Ellico a rider propelled merry-go-round in the form of a simplified propulsion system for which a child's merry-go-round may be operated by hand, rather than by foot, including a small wheel member coupled to a leverage inducing arm. U.S. Pat. No. 4,982,949 to Ulferts discloses a merry-go-round comprising a multiple seat merry-go-round with safety hand rails for riders who do not propel the merry-go-round and pivoting drive handles each connected to a center post with an offset crank, with the offset crank angularly positioned at less than 180 degrees from another offset crank to ensure that there are no dead spots what would render the pivoting drive handles ineffective in starting rotation of the merry-go-round. U.S. Pat. No. 4,286,781 to Ahrens discloses a playground merry-go-round having a body section formed of a rotational molded polyethylene plastic for presenting a completely enclosed merry-go-round with no open areas. U.S. Pat. No. 3,968,961 to Mancusi, Jr.; U.S. Pat. No. 3,698,710 to Schwarzkopf; and U.S. Pat. No. 3,442,509 to Figura are provided as being of general interest.

In this respect, the user propelled merry-go-round according to the present invention substantially departs from the conventional concepts and designs of the prior art, and in so doing provides an apparatus primarily developed for the purpose of affording rotation of a merry-go-round using a bicycle-style method of propulsion.

Therefore, it can be appreciated that there exists a continuing need for a new and improved user propelled merry-go-round which can be used for affording rotation of a merry-go-round using a bicycle-style method of propulsion. In this regard, the present invention substantially fulfills this need.

SUMMARY OF THE INVENTION

In view of the foregoing disadvantages inherent in the known types of merry-go-rounds now present in the prior art, the present invention provides an improved user propelled merry-go-round. As such, the general purpose of the present invention, which will be described subsequently in greater detail, is to provide a new and improved user propelled merry-go-round which has all the advantages of the prior art and none of the disadvantages.

To attain this, the present invention essentially comprises a base comprising a planar circular platform with a post centrally coupled to a top surface thereof and extending vertically upwards therefrom. The base is adapted to rest on a level surface. Also included is a generally X-shaped support pivotally coupled at a central extent thereof to a top end of the post. The support has four support members extending radially from the central extent thereof whereby the support members define four equally partitioned quadrants. Four struts are each coupled between ends of each support member for precluding deformation of the support members. Depending from the support members are four wheel forks each comprising a first leg coupled to a lower surface of the support member at a central extent thereof and extended vertically downward therefrom. The forks also comprise a second leg coupled to a lower surface of the support member at an end thereof and also extended vertically downward therefrom. An axially aligned bore is formed in each of the legs. For supporting a user, four bicycle frames are each situated in one of the quadrants. Each frame comprises an upper beam coupled at an inboard end thereof to a central extent of a first adjacent support member and further extended orthogonally therefrom. A brace is coupled between the upper beam and a second adjacent support member. A lower beam is coupled at an inboard end thereof to a lower portion of the first leg of the fork and further coupled at an outboard end thereof to the outboard end of the upper beam. The lower beam suitably comprises a horizontal inboard portion and a skewed outboard portion. Four seats are each positioned on an upper side of one of the upper beams. An associated back rest is coupled to the outboard end of the upper beam and extended vertically upwards therefrom for preventing the user from being thrown from the apparatus. Affording an additional safety feature are four handle bars each with a generally T-shaped configuration. Each handle bar is coupled to one of the upper beams adjacent to the associated seat. Four wheels are included with associated sprockets axially coupled to one of the forks via the bore thereof. Finally, four pedal units are each axially coupled to the skewed portion of one of the lower beams whereby the sprocket of the pedal unit and the sprocket of the wheel reside in a similar plane with a chain operatively coupled therebetween. Such a construction thus allows a user to precess about the post upon the rotation of the pedal unit wherein the user faces the center of rotation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved user propelled merry-go-round which has all the advantages of the prior art merry-go-rounds and none of the disadvantages.

It is another object of the present invention to provide a new and improved user propelled merry-go-round which may be easily and efficiently manufactured and marketed.

It is a further object of the present invention to provide a new and improved user propelled merry-go-round which is of a durable and reliable construction.

An even further object of the present invention is to provide a new and improved user propelled merry-go-round which is susceptible of a low cost of manufacture with regard to both materials and labor, and which accordingly is then susceptible of low prices of sale to the consuming public, thereby making such user propelled merry-go-round economically available to the buying public.

Still yet another object of the present invention is to provide a new and improved user propelled merry-go-round which provides in the apparatuses and methods of the prior art some of the advantages thereof, while simultaneously overcoming some of the disadvantages normally associated therewith.

Still another object of the present invention is to afford rotation of a merry-go-round using a bicycle-style method of propulsion.

Lastly, it is an object of the present invention to provide a new and improved user propelled merry-go-round including a base with a post centrally coupled to a top surface thereof and extending upwards therefrom. Also included is a support pivotally coupled to the post. The support has a plurality of support members extending radially from the post. A plurality of wheel forks are each coupled to an associated support member and extended vertically downward therefrom with an axially aligned bore formed therein. A plurality of bicycle frames are each coupled to an associated support member with a seat situated thereon. Wheels with associated sprockets are each axially coupled to one of the forks via the bore thereof. A plurality of pedal units are axially coupled to an associated bicycle frame whereby the sprocket of the pedal unit and the sprocket of the wheel reside in a similar plane with a chain operatively coupled therebetween for allowing a user to precess about the post upon the rotation of the pedal unit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
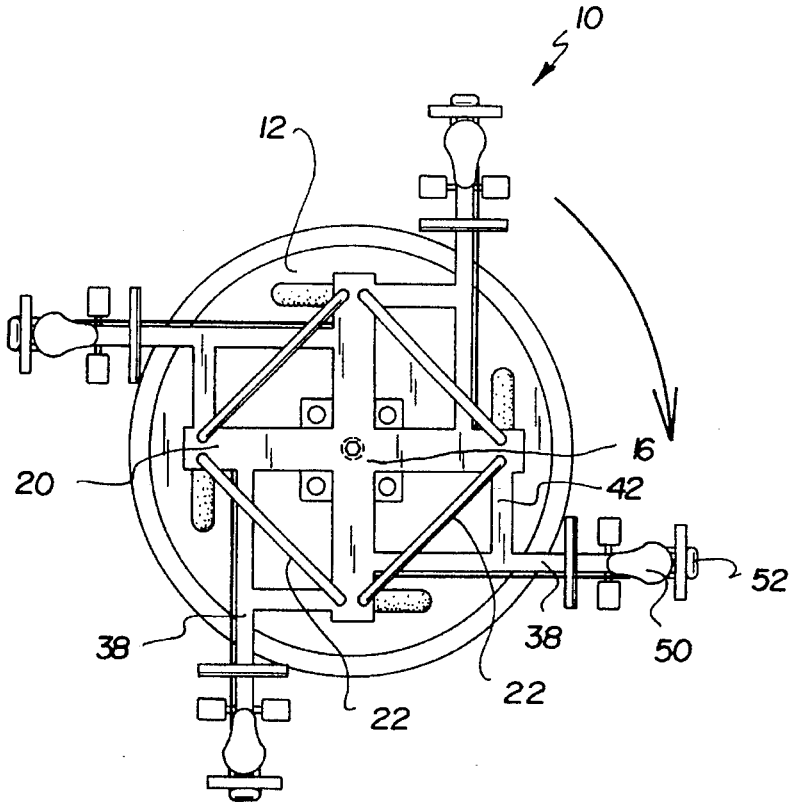
FIG. 1 is a top view of the preferred embodiment of the user propelled merry-go-round constructed in accordance with the principles of the present invention.
Figure 2:
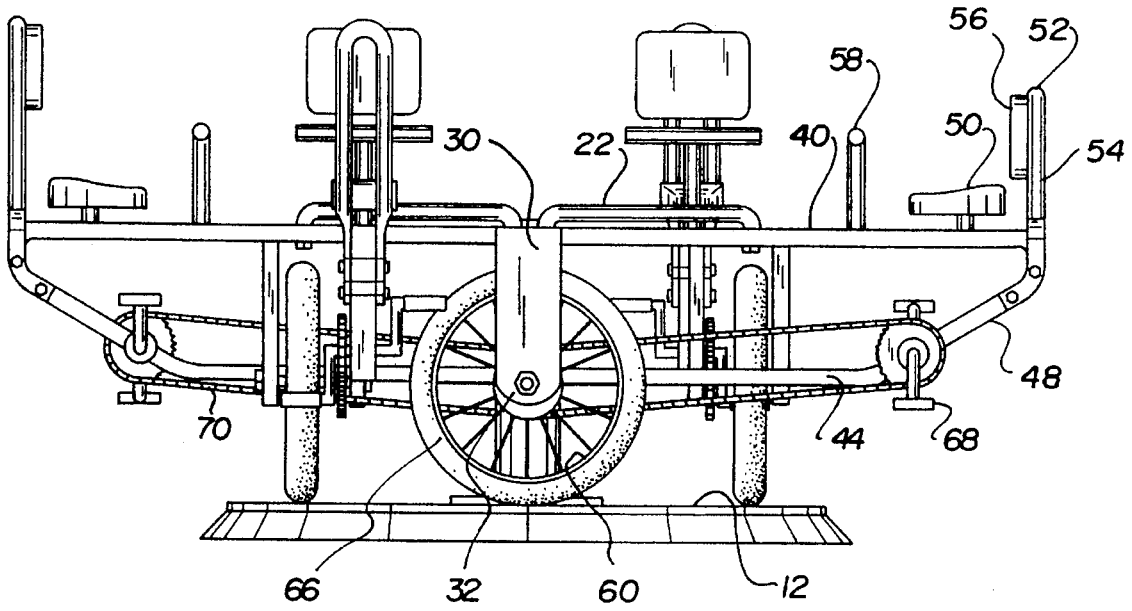
FIG. 2 is a side plan view of the present invention.
Figure 3:
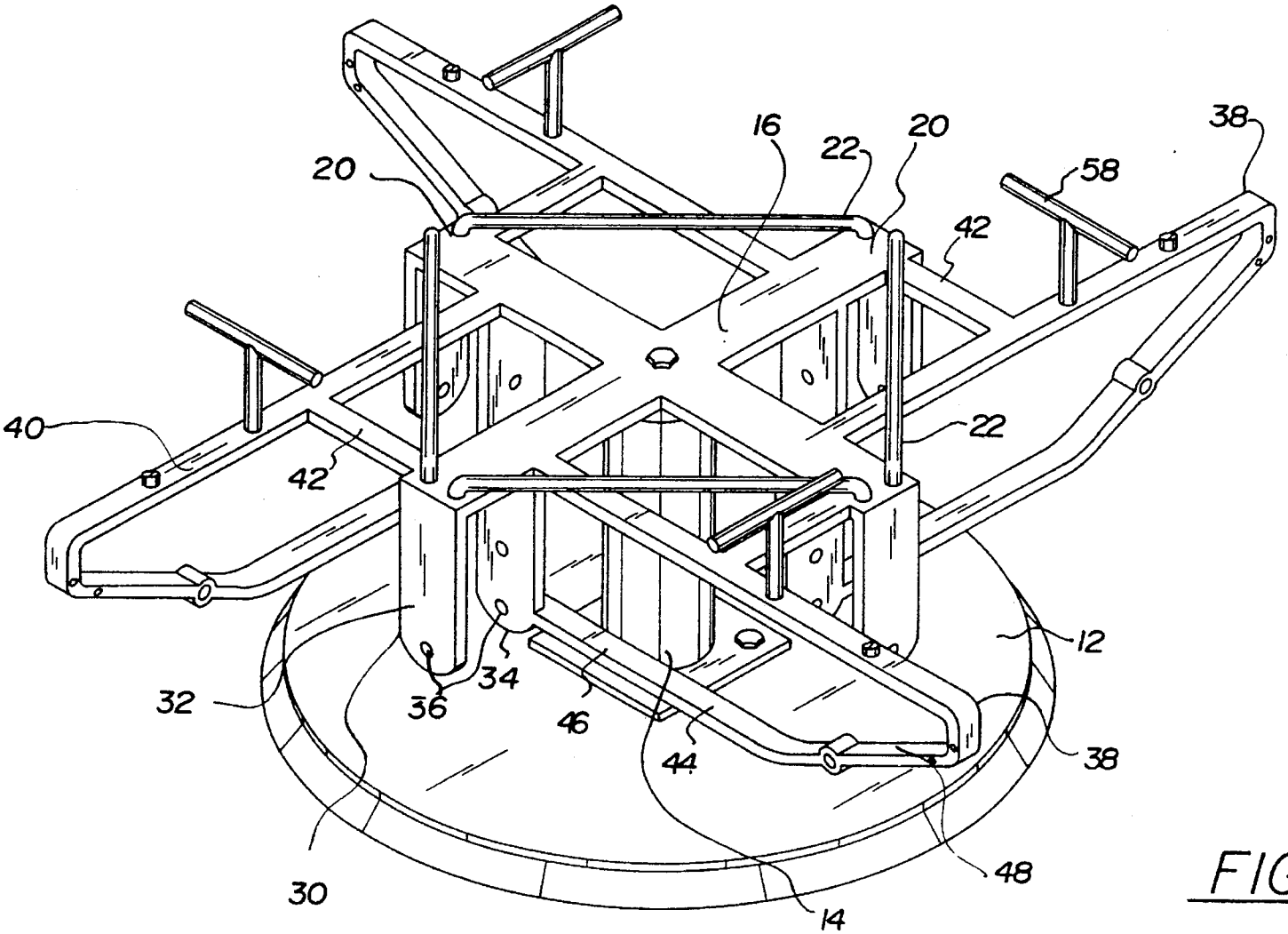
FIG. 3 is a perspective illustration of the base, support, struts, and bicycle frames of the present invention.
Figure 4:
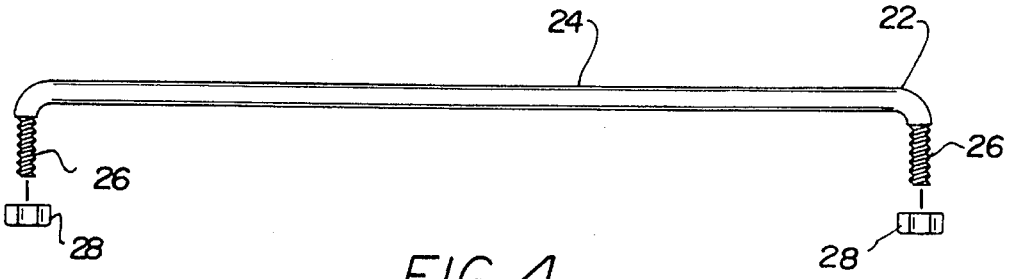
FIG. 4 is a side plan view of a strut used in the present invention.
Figure 5:
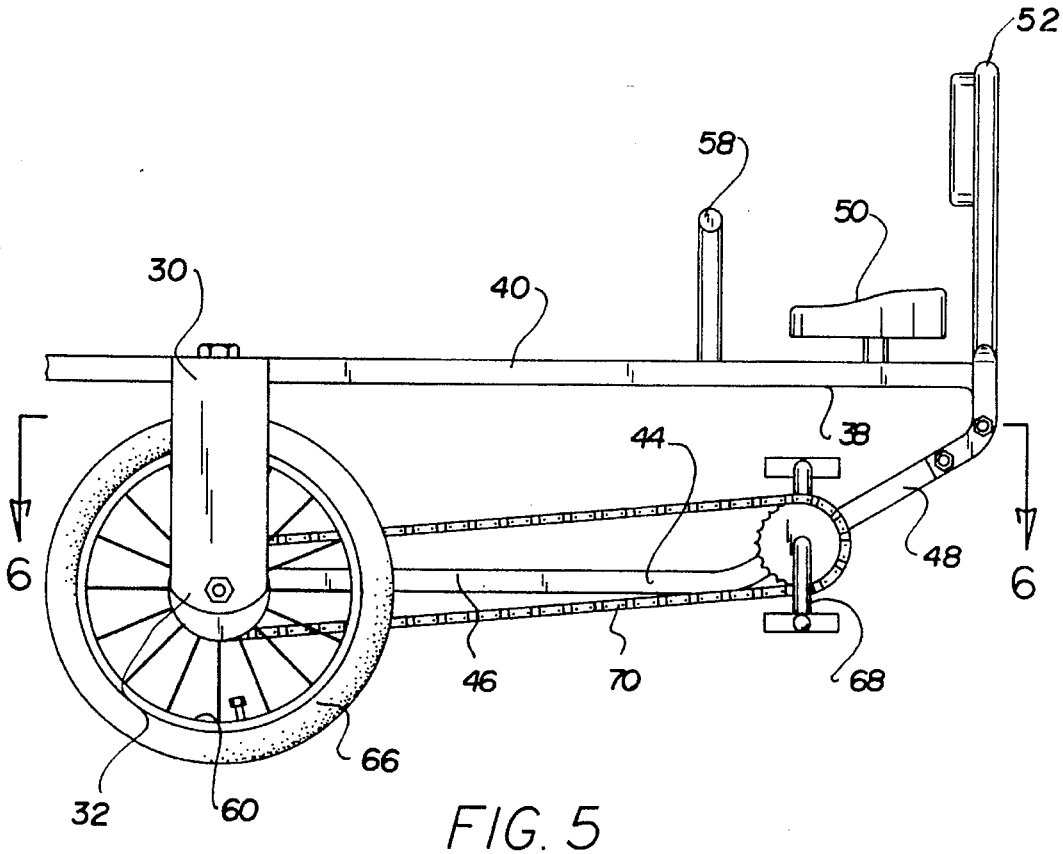
FIG. 5 is a side plan view of one bicycle frame and the components associated therewith.
Figure 6:
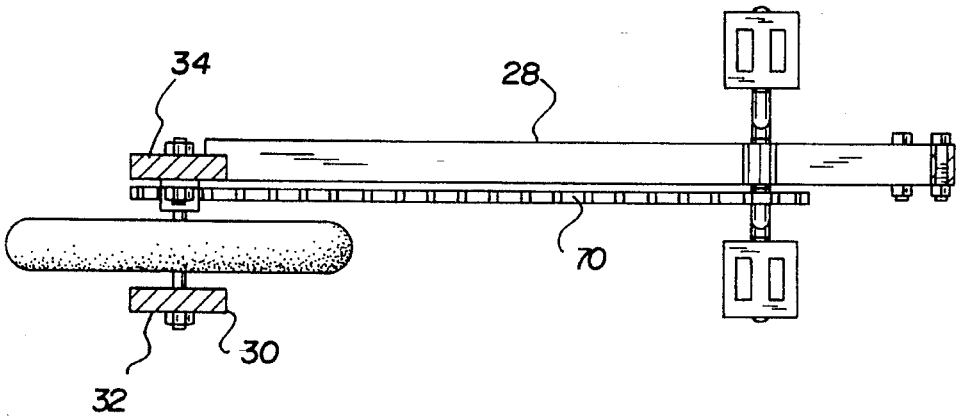
FIG. 6 is a cross-sectional view taken along line 6—6 depicted in FIG. 5.
Figure 9:
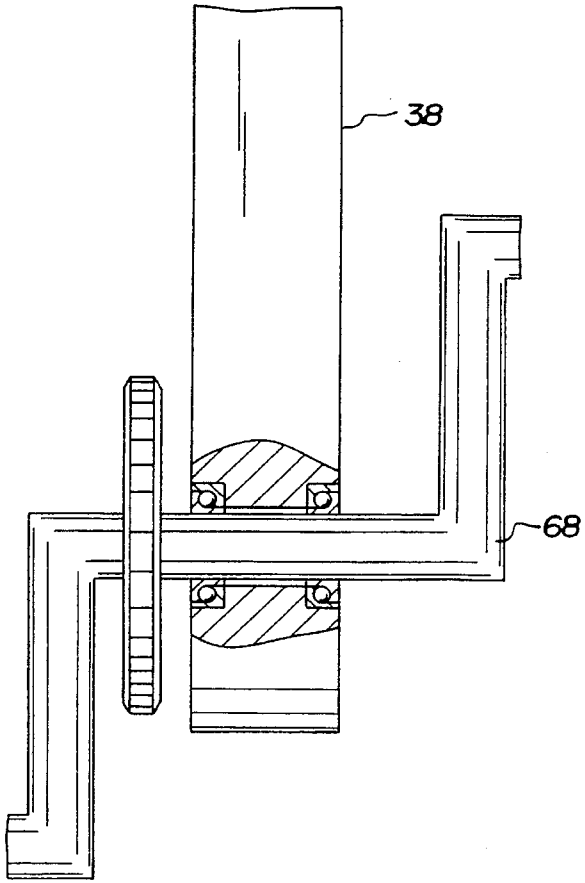
FIG. 9 is a cut-away view of the interconnection of the pedal unit and bicycle frame.
Figure 8:
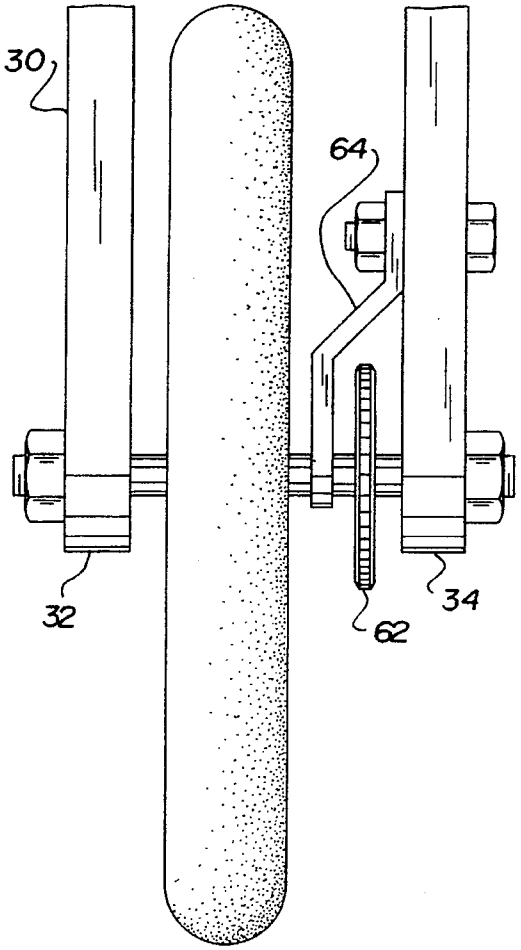
FIG. 8 is an exploded view of the wheel and associated fork of the present invention.
Figure 7:
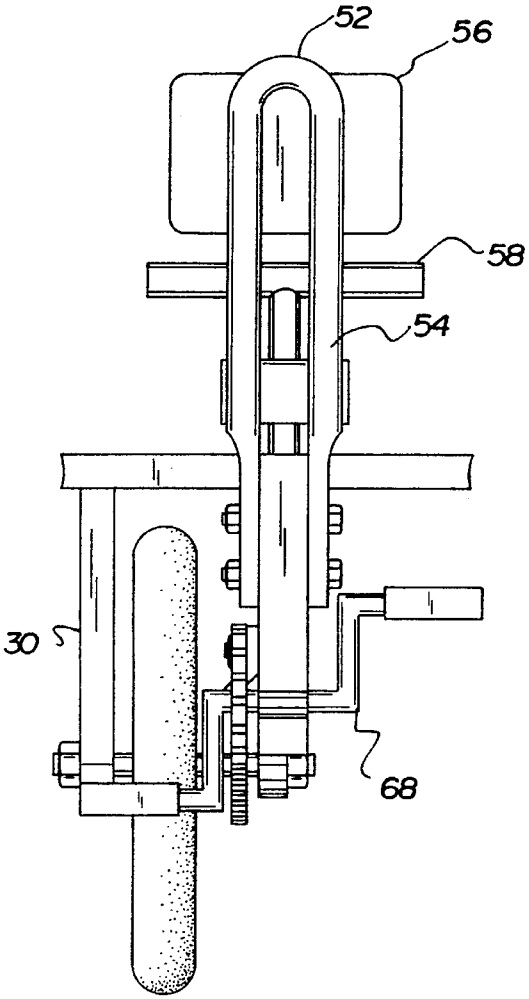
FIG. 7 is a rear plan depiction of the bicycle frame shown in FIG. 5.
Figure 10:
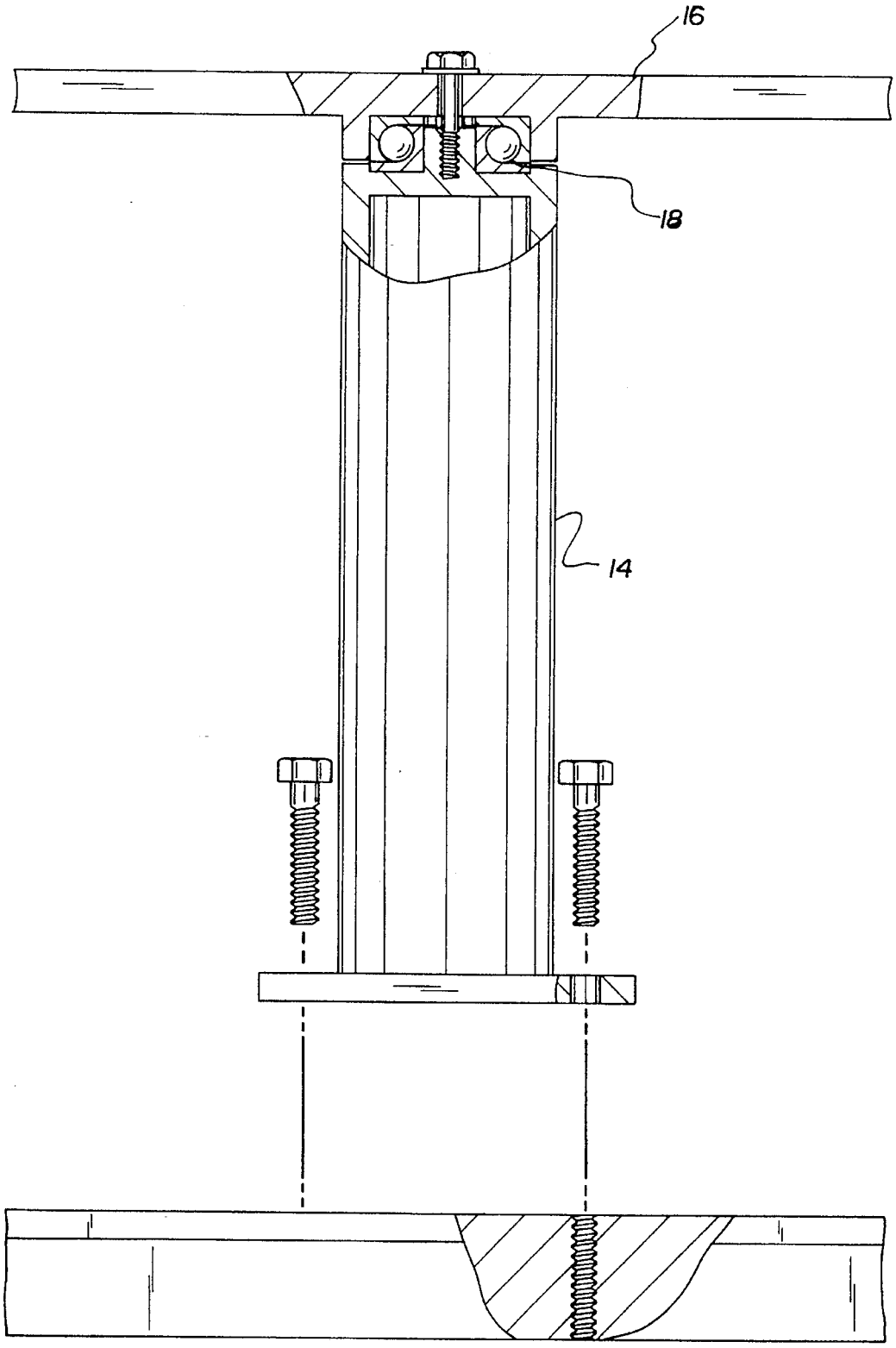
FIG. 10 is cut-away view of the interconnection of the post and platform of the base and further the pivotal coupling between the support and post.

With reference now to the drawings, and in particular to FIG. 1 thereof, a new and improved user propelled merry-go-round embodying the principles and concepts of the present invention and generally designated by the reference numeral 10 will be described.

The present invention, the new and improved user propelled merry-go-round, is comprised of a plurality of components. Such components in their broadest context include a base, support members, struts, forks, bicycle frames, seats, handle bars, wheels, and pedal units. Such components are individually configured and correlated with respect to each other so as to attain the desired objective.

More specifically, it will be noted that the system 10 of the present invention includes a base comprising a planar circular platform 12 with a post 14 centrally coupled to a top surface thereof and extending vertically upwards therefrom. The post may be bolted to the platform or integrally formed therewith. Ideally, the circular platform has a diameter of approximately 6–8 feet and the post has a height of approximately 20–30 inches. The base is adapted to rest on a level surface.

Also included is a generally X-shaped support 16 pivotally coupled at a central extent thereof to a top end of the post. Heavy duty bearings 18 are included to afford efficient rotation of the support. The support has four support members 20 extending radially from the central extent thereof, wherein the support members define four equally partitioned quadrants.

Four struts 22 are each coupled between ends of each support member for precluding deformation of the support members. Each strut includes an elongated rod 24 with a pair of threaded ends 26 orthogonally formed thereon. In an operative orientation, the ends of the rod are adapted to be screwably secured within apertures formed in the ends of the support members with associated nuts 28.

Depending from the support members are four wheel forks 30 each comprising a first leg 32 coupled to a lower surface of the support member at a central extent thereof and extended vertically downward therefrom. The forks also comprise a second leg 34 coupled to a lower surface of the support member at an end thereof and also extended vertically downward therefrom. An axially aligned bore 36 is formed in each of the legs.

For supporting a user, four bicycle frames 38 are each situated in one of the quadrants. Each frame comprises an upper beam 40 coupled at an inboard end thereof to a central extent of a first adjacent support member and further extended orthogonally therefrom. A brace 42 is integrally coupled between the upper beam and a second adjacent support member. A lower beam 44 is coupled at an inboard end thereof to a lower portion of the first leg of the fork and further coupled at an outboard end thereof to the outboard end of the upper beam. The lower beam suitably comprises a horizontal inboard portion 46 and a skewed outboard portion 48. Preferably, the upper beam of the bicycle frame has a length more than twice the same of the associated support members in order to allow the user suitable space for movement.

Four seats 50 are each positioned on an upper side of one of the upper beams. An associated back rest 52 is coupled to the outboard end of the upper beam and extended vertically upwards therefrom for preventing the user from being thrown from the apparatus. Each back rest is essentially formed of a generally U-shaped member 54 with a pad 56 coupled thereto on an inboard side thereof.

Affording an additional safety feature are four handle bars 58 each with a generally T-shaped configuration. Each handle bar is coupled to one of the upper beams between the associated seat and the center of the apparatus.

Four wheels 60 are included each with an associated sprocket 62 axially coupled to one of the forks via the bore thereof. To further support the sizable weight of the device and the riders thereof, an additional skewed brace 64 is included comprising a top end connected to an inner surface of the first leg of the fork and a bottom end axially coupled between the wheel and associated sprocket thus precluding deformation of the axle. The wheels include inflatable tires 66 so as to effect maximum contact with the platform upon the inflation thereof. A standard braking mechanism is situated within the axle of each wheel. The brake may be actuated by merely rotating the associated sprocket in a direction opposed to motion.

Finally, four pedal units 68 are each axially coupled to the skewed portion of one of the lower beams whereby the sprocket of the pedal unit and the sprocket of the wheel reside in a similar plane with a chain 70 operatively coupled therebetween. Ideally, the sprocket of the wheel and the sprocket of the pedal unit have an equivalent diameter in order to effect easy revolution and to avoid dangerous rotational speeds. Such a construction thus allows a user to precess about the post upon the rotation of the pedal unit wherein the user faces the center of rotation.

The present invention affords a novel apparatus which can be enjoyed by adults and children alike. The device may be employed for either entertainment or exercise motives. Day care centers, parks, recreation facilities, and the like are suitable areas of application of the present device.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

what is claimed as being new and desired to be protected by Letters Patent of the United States is as follows:

1. A new and improved user propelled merry-go-round comprising, in combination:

a base comprising a planar circular platform with a post centrally coupled to a top surface thereof and extending vertically upwards therefrom, the base adapted to rest on a level surface;

a generally X-shaped support pivotally coupled at a central extent thereof to a top end of the post, the support having four support members extending radially from the central extent thereof whereby the support members define four equally partitioned quadrants;

four struts each coupled between ends of each support member;

four wheel forks each situated on one of the support members, each fork comprising a first leg coupled to a lower surface of the support member at a central extent thereof and extended vertically downward therefrom, a second leg coupled to a lower surface of the support member at an end thereof and also extended vertically downward therefrom, and an axially aligned bore formed in each of the legs;

four bicycle frames each situated in one of the quadrants, each frame comprising an upper beam coupled at an inboard end thereof to a central extent of a first adjacent support member and further extended orthogonally therefrom with a brace coupled between the upper beam and a second adjacent support member, each bicycle frame further including a lower beam coupled at an inboard end thereof to a lower portion of the first leg of the fork and further coupled at an outboard end thereof to the outboard end of the upper beam whereby the lower beam comprises a horizontal inboard portion and a skewed outboard portion;

four seats each positioned on an upper side of one of the upper beams with an associated back rest coupled to the outboard end of the upper beam and extended vertically upwards therefrom;

four handle bars each with a generally T-shaped configuration, each handle bar coupled to one of the upper beams adjacent to the associated seat;

four wheels each with an associated sprocket axially coupled to one of the forks via the bore thereof; and four pedal units axially coupled to the skewed portion of the one of the lower beams whereby the sprocket of the pedal unit and the sprocket of the wheel reside in a similar plane with a chain operatively coupled therebetween for allowing a user to precess about the post upon the rotation of the pedal unit whereby the user faces the center of rotation.

2. A user propelled merry-go-round comprising:

a base with a post centrally coupled to a top surface thereof and extending upwards therefrom;

a support pivotally coupled to the post, the support having at least one support member extending radially from the post;

at least one wheel fork coupled to an associated support member and extended vertically downward therefrom with an axially aligned bore formed therein;

at least one bicycle frame coupled to an associated support member;

at least one seat on an associated bicycle frame;

at least one wheel with an associated sprocket axially coupled to one of the forks via the bore thereof; and at least one pedal unit axially coupled to an associated bicycle frame with a chain operatively coupled between the sprocket of the wheel and the sprocket of the pedal unit for allowing a user to precess about the post upon the rotation of the pedal unit.

3. A user propelled merry-go-round as set forth in claim 2 wherein the base further comprises a planar circular platform for allowing at least one wheel to rest thereon.

4. A user propelled merry-go-round as set forth in claim 2 and further comprising a strut coupled between ends of each support member.

5. A user propelled merry-go-round as set forth in claim 2 wherein each bicycle frame comprises an upper beam coupled at an inboard end thereof to a central extent of the support member and further extended orthogonally therefrom and a lower beam coupled at an inboard end thereof to a lower portion of the fork and further coupled at an outboard end thereof to the outboard end of the upper beam whereby the lower beam comprises a horizontal inboard portion and a skewed outboard portion.

6. A user propelled merry-go-round as set forth in claim 2 and further comprising at least one handle bar with a generally T-shaped configuration, each handle bar coupled to an associated bicycle frame adjacent to the seat thereof.

7. A user propelled merry-go-round as set forth in claim 2 wherein the user faces the center of rotation.

* * * * *